US012163525B2

(12) United States Patent
Hollingsæter et al.

(10) Patent No.: US 12,163,525 B2
(45) Date of Patent: Dec. 10, 2024

(54) SUBSEA PUMP SYSTEM WITH PROCESS LUBRICATED BEARINGS

(71) Applicant: FSubsea AS, Oslo (NO)

(72) Inventors: Terje Hollingsæter, Lommedalen (NO); Tommy Westberg, Torsby (SE); Christian Wik Høy, Oslo (NO)

(73) Assignee: FSubsea AS, Oslo (NO)

( * ) Notice: Subject to any disclaimer, the term of this patent is extended or adjusted under 35 U.S.C. 154(b) by 379 days.

(21) Appl. No.: 17/299,370

(22) PCT Filed: Dec. 20, 2019

(86) PCT No.: PCT/EP2019/086686
§ 371 (c)(1),
(2) Date: Jun. 3, 2021

(87) PCT Pub. No.: WO2020/127977
PCT Pub. Date: Jun. 25, 2020

(65) Prior Publication Data

US 2022/0042512 A1 Feb. 10, 2022

(30) Foreign Application Priority Data

Dec. 20, 2018 (NO) ..... 20181663

(51) Int. Cl.
*F04D 13/08* (2006.01)
*F04C 15/00* (2006.01)
(Continued)

(52) U.S. Cl.
CPC ..... *F04D 13/08* (2013.01); *F04C 15/0088* (2013.01); *F04D 1/14* (2013.01);
(Continued)

(58) Field of Classification Search
CPC ..... F04D 13/08; F04D 1/14; F04D 13/0633; F04D 29/046; F04D 29/061; F04D 31/00;
(Continued)

(56) References Cited

U.S. PATENT DOCUMENTS 3,186,513 A 6/1965 Dunn et al.
10,066,635 B2 * 9/2018 Trottmann ..... F04D 29/06
(Continued)

FOREIGN PATENT DOCUMENTS

WO WO-2014042626 A1 3/2014
WO WO-2015097502 A1 7/2015
(Continued)

OTHER PUBLICATIONS

Gombert, Ralf; International Search Report; PCT/EP2019/086686; dated Apr. 14, 2020; 4 pages.

*Primary Examiner* — Dominick L Plakkoottam
(74) *Attorney, Agent, or Firm* — Bradley Arant Boult Cummings LLP

(57) ABSTRACT

A subsea pump system includes a subsea centrifugal pump with a motor compartment and a process compartment. The subsea pump system further includes a liquid phase separator arranged downstream to the pump or downstream to at least one pump impeller. The liquid phase separator includes an inlet receiving the pressure boosted fluid, an outlet delivering a majority, or a minor part, of the pressure boosted fluid, and a liquid phase outlet, a liquid recirculation line, a flow mixer arranged on the inlet side of the pump, and a liquid lubricant line.

13 Claims, 4 Drawing Sheets

(51) Int. Cl.

| | |
|---|---|
| ***F04D 1/14*** | (2006.01) |
| ***F04D 13/02*** | (2006.01) |
| ***F04D 13/06*** | (2006.01) |
| ***F04D 29/046*** | (2006.01) |
| ***F04D 31/00*** | (2006.01) |

(52) U.S. Cl.
CPC ..... *F04D 13/024* (2013.01); *F04D 13/0633* (2013.01); *F04D 13/086* (2013.01); *F04D 29/046* (2013.01); *F04D 31/00* (2013.01)

(58) Field of Classification Search
CPC ..... F04D 1/06; F04D 13/024; F04D 29/708; F04D 13/086; F04C 15/0088
See application file for complete search history.

(56) References Cited

U.S. PATENT DOCUMENTS

| | | | | |
|---|---|---|---|---|
| 10,463,990 | B2 * | 11/2019 | Becquin ..... | B01D 19/0063 |
| 2004/0144534 | A1 | 7/2004 | Lee | |
| 2005/0069434 | A1 | 3/2005 | Tani | |
| 2010/0278672 | A1 | 11/2010 | Kothnur et al. | |
| 2013/0209226 | A1 | 8/2013 | Trottmann | |
| 2015/0267704 | A1 * | 9/2015 | Sinnerud ..... | F04D 13/0653 417/420 |
| 2015/0308444 | A1 * | 10/2015 | Trottmann ..... | F04D 9/003 415/169.1 |
| 2016/0333677 | A1 * | 11/2016 | Westberg ..... | F04D 13/086 |
| 2016/0341209 | A1 | 11/2016 | Landi et al. | |
| 2017/0306966 | A1 | 10/2017 | Valland et al. | |
| 2018/0172015 | A1 * | 6/2018 | Manzari ..... | F04D 29/0473 |
| 2018/0231013 | A1 * | 8/2018 | Trottmann ..... | F04D 29/708 |
| 2021/0156384 | A1 | 5/2021 | Fuglesang et al. | |

FOREIGN PATENT DOCUMENTS

| | | | |
|---|---|---|---|
| WO | WO-2016049377 | A1 | 3/2016 |
| WO | WO-2018077527 | A1 | 5/2018 |
| WO | WO-2018190726 | A1 | 10/2018 |
| WO | WO-2019209120 | A1 | 10/2019 |

* cited by examiner

SUBSEA PUMP SYSTEM WITH PROCESS LUBRICATED BEARINGS

TECHNICAL FIELD

The present invention relates to process fluid lubricated bearings in subsea pumps.

BACKGROUND ART

Barrier fluid, supplied at controlled overpressure via a long supply chain, typically from a topside hydraulic power unit, is the standard solution for lubricating bearings and mechanical seals in subsea pressure boosters, including subsea pumps and subsea multiphase pumps.

A few solutions are described and illustrated for using process fluid as bearing lubricant, in subsea multiphase pumps or subsea pumps.

In patent publication WO 2014/042626 A1 a multiphase pump is described and illustrated, for which a flow of substantially liquid is extracted from the multiphase fluid to lubricate a bearing. The substantially liquid fluid is extracted by a fluid separator system arranged upstream to the pump.

In patent publications US 2013/0209226 A1, US 2015/0308444 A1 and US 2018/0231013 A1 an internal separation device on the multiphase pump rotor, upstream to the multiphase pump impellers, separates and provides lubricating fluid to the rotor, by separating multiphase fluid to a gas-enriched gas component, a liquid enriched liquid component for said lubrication, and a solid component.

Some further patent publications relevant for the present invention are: U.S. Pat. No. 3,186,513 A, US 2017/0306966 A1, US 2016/0341209 A1, US 2005/0069434 A1, WO 2018/077527 and US 2018/0172015 A1.

In patent publication US 2010/0278672 A1, a twin-screw pump with a plurality of rotors is described and illustrated. All liquid, in addition to any particles, are apparently separated out for use as lubricant together with used lubricant. The pressure head and rotational speed for twin screw pumps are limited compared to centrifugal pumps, and lubricant arrangements for twin screw pumps may not be feasible for centrifugal pumps.

A multiphase fluid is variable with respect to phase composition, sand contents, pressure and even temperature, making solutions for multiphase pump bearing lubrication using process fluid as lubricant very challenging. Single phase fluids can be contaminated, and can also be very challenging with respect to using the pumped fluid as lubricant, A demand still exists for a simple and reliable subsea pump with process lubricated bearings.

SUMMARY OF INVENTION

The invention meets the demand by providing a subsea pump system, comprising a subsea centrifugal pump with a motor compartment and a process compartment,

- wherein the motor compartment is separate from the process compartment and comprises an electric motor or a stator driving a motor shaft,
- wherein the process compartment comprises a pump arranged on a pump rotor, an inlet for fluid and an outlet for pressure boosted fluid, and
- wherein the motor shaft via a coupling preferably drives the pump rotor.

The subsea pump system is distinguished in that it further comprises

- a liquid phase separator arranged downstream to the pump or downstream to at least one pump impeller, the liquid phase separator comprising:
  - an inlet receiving the pressure boosted fluid,
  - an outlet delivering a majority, or a minor part, of the pressure boosted fluid, and
  - a liquid phase outlet,
- a liquid recirculation line or -conduit,
- a flow mixer arranged on the inlet side of the pump, wherein the liquid recirculation line or -conduit is arranged from the liquid phase outlet to the flow mixer, and
- a liquid lubricant line or -conduit arranged from a location containing pressure boosted fluid to one or more process compartment bearings, directly or via other equipment, for lubricating said process compartment bearings.

Preferably, the liquid phase separator arranged downstream to the pump or downstream to at least one pump impeller separates out only a part of the liquid, preferably only an minor part of the liquid, preferably not the lightest liquid fraction and not the heaviest liquid fraction but an intermediate fraction of the liquid. This means that of the pressure boosted fluid, all gas, most or some of the liquid, and all particles are not separated out but are directed out through the outlet of the liquid separator. In contrast, the nearest prior art solutions prescribe as obligatory to separate multiphase fluid into gas, oil and water, upstream or in between the pump impellers; or prescribe as obligatory to separate out all liquid, in practice meaning all oil, water and all particles of the process flow, for use of said liquid as lubricant.

The flow mixer is a process fluid flow mixer, arranged in the process inlet or the process inlet line to the pump.

In some embodiments, the liquid phase separator, the liquid recirculation line or -conduit, the second stage liquid separator if present, and the flow mixer, are integrated into the pump, inside the process compartment.

The subsea pump system of the invention preferably comprises a liquid lubricant impeller, arranged with respect to flow direction between the liquid lubricant line and the at least one process compartment bearing, wherein the liquid lubricant impeller is arranged on the pump rotor or as part of a lubricant pump external to the process compartment.

The subsea pump system of the invention preferably further comprises a second stage liquid separator, preferably arranged in the liquid recirculation line or -conduit, for conditioning the recirculated liquid further for service as liquid lubricant, wherein the liquid lubricant line is arranged from the second stage separator to said process compartment bearings, directly or via other equipment, preferably via a liquid lubricant impeller. Preferably, only a part of the liquid received by the second stage liquid separator is separated out and directed to the bearings as lubricant. Preferably, only a liquid fraction typically containing the most feasible fraction for use as lubricant is separated out in the second stage separator. Said fraction is not the lightest and not the heaviest fraction, but an intermediate fraction of the liquid entering the second stage separator. The second stage liquid separator can be arranged in the pump compartment, preferably together with a liquid lubricant impeller on the pump rotor, for example allowing a heaviest fraction and/or a lightest fraction of the liquid lubricant to leak controlled into the process fluid.

The subsea pump system of the invention preferably further comprises an inlet for methanol, glycol or other liquid feasible for bearing lubrication, coupled to the liquid lubricant line or directly to the process compartment, for delivering said methanol, glycol or other liquid for bearing lubrication. Preferably, said inlet is connected to a line for liquid injection for flow assurance, preferably an umbilical flow bore or a separate line arranged to subsea field equipment for ensuring flow assurance by preventing hydrate formation. Flow assurance is crucial for maintaining production. Hydrate formation, such as during an unplanned shutdown, can block the production, and one technique for avoiding hydrate formation is injection of glycol, such as MEG, or methanol, into all flowlines at the wellhead. As a redundancy, said MEG or glycol can thereby also be used for bearing lubrication, and if relevant, also for maintaining an overpressure in the motor compartment.

Most preferably the subsea pressure booster comprises a magnetic coupling and a separation wall arranged between magnetic coupling parts, the separation wall separating the motor compartment hermetically from the process compartment while the motor shaft is magnetically coupled to drive the multiphase pump rotor through the separation wall. The motor compartment can then be hermetically closed, except for optional pressure compensators or sensor/instrumentation or cooling circuit feedthroughs, but without any supply of barrier fluid through a long, pressure-controlled supply chain. Preferably, the magnetic coupling is according to the teaching of the Applicant's international patent publication WO 2018/190726 A1, to which reference is made for further information.

Alternatively, the subsea pressure booster comprises a hydraulic variable speed drive, arranged between the motor compartment and the process compartment or inside the motor compartment facing the process compartment, coupling the motor shaft to the pump rotor, through a separation wall separating the motor compartment from the process compartment. In this embodiment, the motor compartment may have a small leakage from the motor compartment to the process compartment, which leakage must be replaced. Preferably, an inlet to the motor compartment is coupled to a supply of methanol or glycol for replacing said small leakage, which methanol and glycol primarily is used for subsea field flow assurance. With the present invention, said methanol or glycol is preferably used also as a redundant process compartment bearing lubricant, and for multiphase pumps or pumps with risk for some leakage from the motor compartment, as fluid supply to the motor compartment. The hydraulic variable speed drive preferably is according to the teaching of the Applicant's international patent application PCT/NO2019/050094, to which reference is made for further information.

Alternatively, one common shaft with shaft seal through a separation wall, and overpressure in the motor compartment, is a possible feature or arrangement in pump systems of the invention.

The pump preferably is a subsea multiphase pump, wherein liquid for process compartment bearing lubrication is separated out from the pressure boosted multiphase fluid in two stages, the liquid phase separator and the second stage liquid separator, respectively, wherein said liquid is supplied via a liquid lubricant line from the second stage liquid separator.

The liquid for lubricating the bearings is directed from the liquid lubricant line or -conduit directly or via a liquid lubricant impeller with or without a second stage liquid separator, to bearings in the process compartment.

As an alternative for pumps with high differential pressure, the liquid for bearing lubrication can be taken out from one of the impeller stages upstream to the last impeller stage, directing said liquid to process compartment bearings directly inside the process compartment or via an external to the process compartment liquid lubricant line. However, more preferably the liquid is separated in the liquid phase separator arranged downstream to the pump, preferably conditioned by separation in the second stage liquid separator, from where the liquid preferably is supplied to a lubricant impeller on the pump rotor, via the liquid lubricant line. A pressure control device, such as a control valve, is preferably included in the supply chain between the liquid phase separator and the process compartment bearing, wherein a lubricant impeller can be superfluous if the lubricant pressure is sufficient.

For embodiments without a second stage liquid separator in the liquid recirculation line, the liquid lubricant line is preferably arranged from a liquid filled part of the liquid phase separator to the pump compartment, supplying lubricant directly to the bearings or via a lubricant impeller with or without a second stage liquid separator.

The invention also provides a method for lubricating the bearings in a process compartment of a subsea pump system comprising a subsea centrifugal pump with a motor compartment and a process compartment.

The method is distinguished by:

- separating out a liquid phase in a liquid phase separator arranged downstream to the pump or downstream to at least one pump impeller,
- discharging the separated-out liquid into a liquid recirculation line or -conduit, arranged from a liquid phase outlet from the liquid phase separator to a flow mixer arranged on the inlet side of the pump, and
- directing a flow of liquid fluid as lubricant to at least one process compartment bearing, via a liquid lubricant line or -conduit arranged from the liquid recirculation line or -conduit, preferably via a second stage liquid separator upstream to the liquid lubricant line and preferably also via a liquid lubricant impeller on the downstream side of the liquid lubricant line.

Furthermore, the invention provides use of liquid separated out from pressure boosted fluid in a liquid phase separator arranged downstream to a subsea pump, as liquid lubricant for bearings in a process compartment of said subsea pump, preferably the liquid has been further separated in a second stage liquid separator and preferably the liquid has been pressure boosted by a liquid lubricant impeller on the downstream side of the liquid lubricant line.

DETAILED DESCRIPTION OF THE INVENTION

Figure 1:
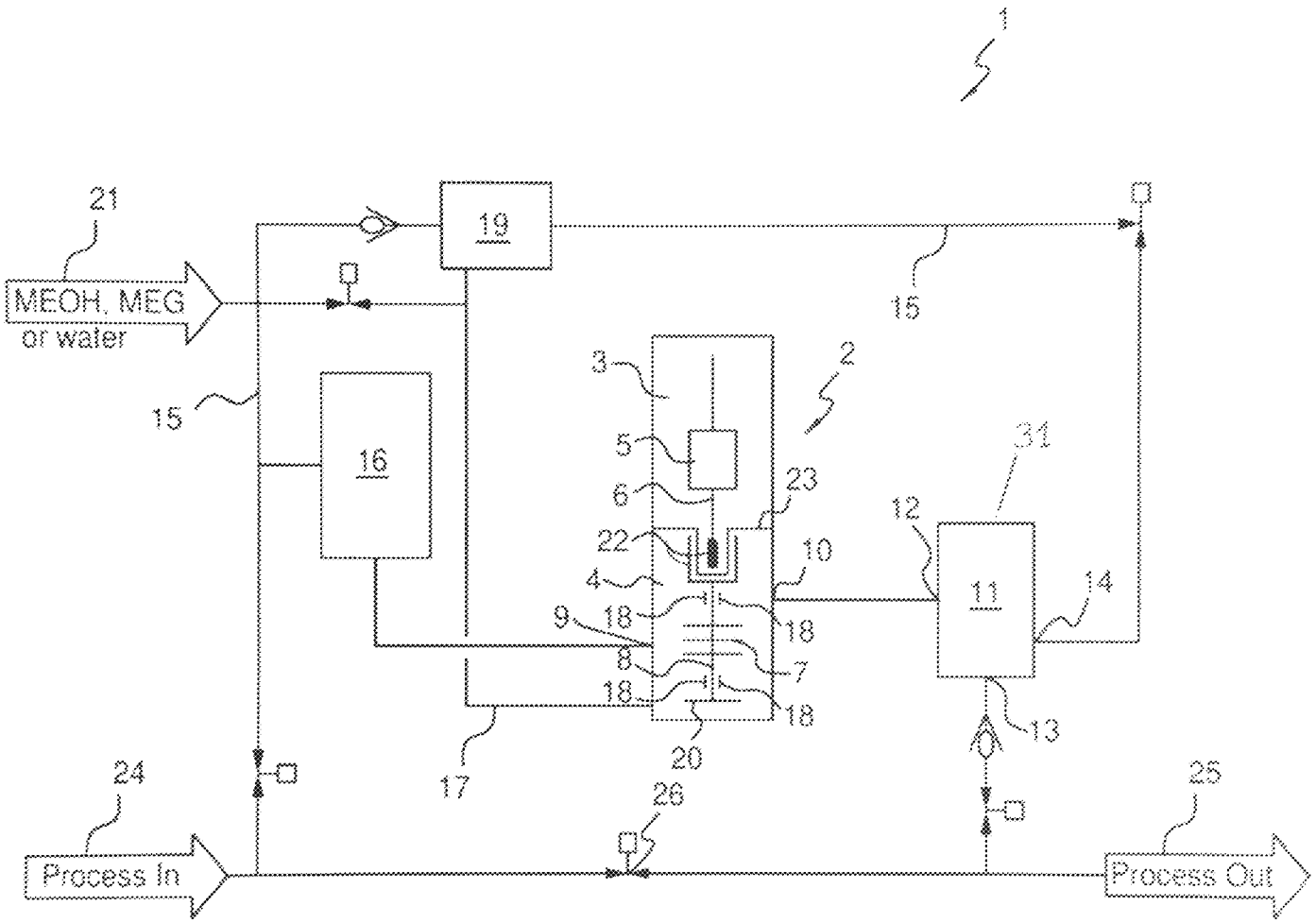
FIG. 1 illustrates an embodiment of a subsea pump system of the invention.

Reference is made to FIG. 1, illustrating a subsea pump system 1 embodiment of the invention.

The subsea pump system 1 comprises a subsea pump 2, such as a subsea multiphase pump, with a motor compartment 3 and a process compartment 4. The motor compartment 3 is separate from the process compartment 4 and comprises an electric motor 5 driving a motor shaft 6. The process compartment 4 comprises a multiphase pump 7 arranged on a pump rotor 8, an inlet for process fluid 9 and an outlet 10 for pressure boosted fluid. The motor shaft drives the multiphase pump rotor via a magnetic coupling 22. A liquid phase separator 11 is arranged downstream to the multiphase pump, the liquid phase separator comprising: a housing 31 having exterior fluid connections; an inlet 12 receiving the pressure boosted multiphase fluid; an outlet 13 delivering a majority of the pressure boosted multiphase fluid; and a liquid phase outlet 14 delivering a part of the pressure boosted liquid into a liquid recirculation line 15. A flow mixer 16 is arranged on the process fluid inlet side of the multiphase pump, wherein the liquid recirculation line is arranged from the liquid phase outlet to the flow mixer, via a second stage liquid separator 19. A liquid lubricant line 17 arranged from the liquid recirculation line for directing a flow of liquid fluid as lubricant to at least one process compartment bearing 18.

A liquid lubricant impeller 20, arranged with respect to flow direction between the liquid lubricant line and the at least one process compartment bearing, is illustrated. In the illustrated embodiment the liquid lubricant impeller 20 is arranged on the multiphase pump rotor 8.

The liquid lubricant impeller can be arranged on the pump rotor in the distal end or the near end relative to the motor compartment. The liquid lubricant line 17 can be arranged to the pump compartment in the distal or the near end from the motor compartment or be divided or be double lines arranged to each ends/sides of the pump compartment/pump rotor.

Further, an inlet 21 for methanol, glycol or other flow assurance liquid, surprisingly also feasible for bearing lubrication, is for redundancy coupled to the liquid lubricant line for delivering said methanol, glycol or other liquid for bearing lubrication, as illustrated.

Dependent on the bearings of the pump compartment of the pump system of the invention, the liquid of the liquid lubricant is one of water, oil, glycol, methanol and any mixture thereof. A practical achievable minimum of particle contents is preferred in said liquid or mixture. Bearings under development are expected to tolerate gas in a limited period of time, when such bearings become available the liquid can also include gas within the tolerable time periods for the bearings.

The magnetic coupling 22 couples the motor shaft 6 to the pump rotor 8. A static separation wall 23, between two rotating magnetic coupling parts, separates the motor compartment hermetically from the process compartment. No external supply of barrier fluid is required through a long pressure-controlled supply chain, since the motor compartment is designed for operation throughout the lifetime with prefilled lubricant/coolant, while the separated liquid is lubricant for bearings and seals of the process compartment. Preferably, also a hydraulic variable speed drive (not illustrated) is arranged between the motor and the magnetic coupling. An external variable speed drive, VSD, can thereby be eliminated.

Process fluid enters the subsea pump system via process inlet 24 and pressure boosted process fluid exits the subsea pump system via process outlet 25. The valve 26 between said inlet and outlet is usually closed.

Figure 2:
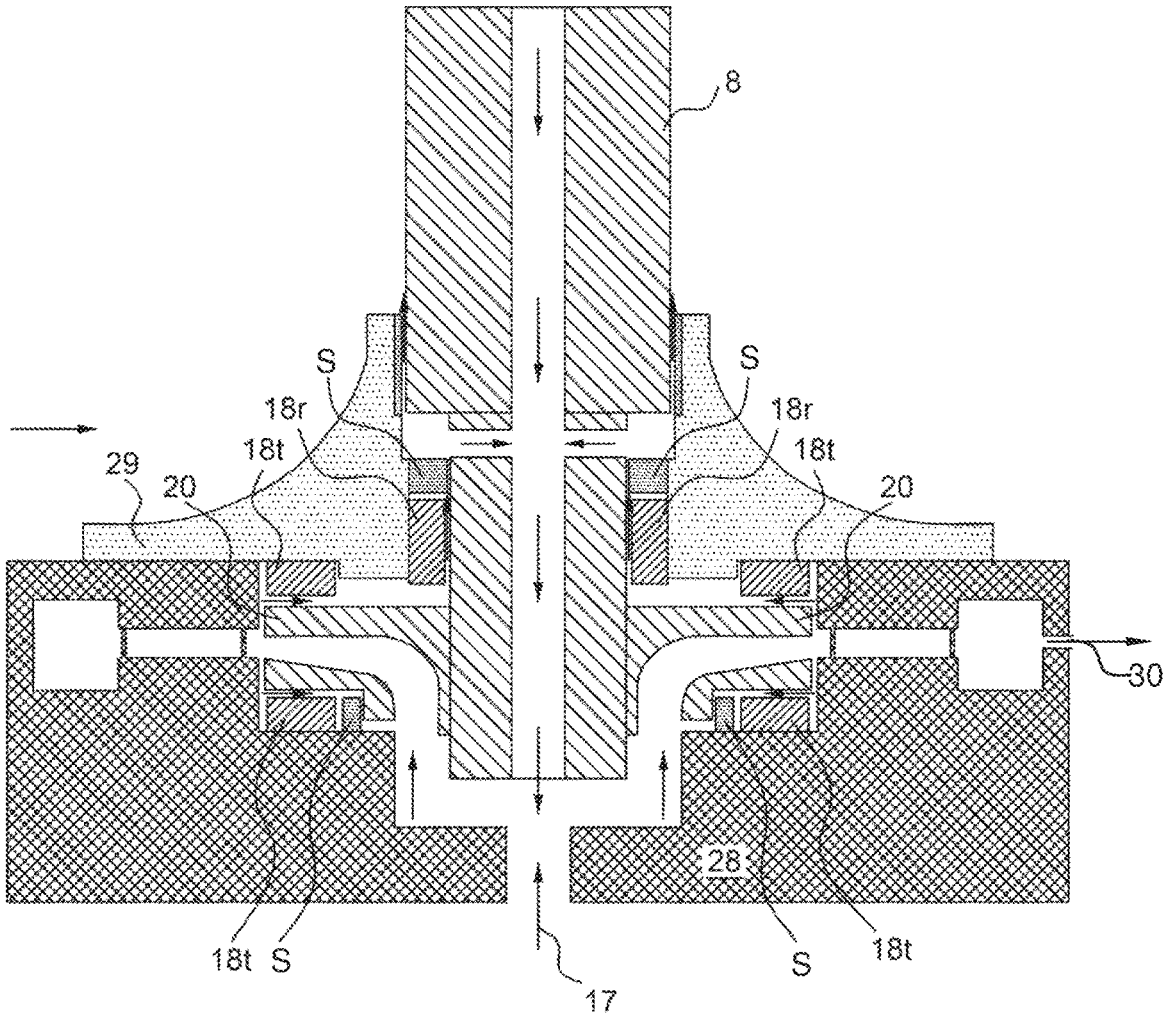
FIG. 2 illustrates an embodiment of a liquid lubricant impeller in a subsea pump system of the invention.

Reference is made to FIG. 2 illustrating in more detail an embodiment of a liquid lubricant impeller 20 in a subsea pump system of the invention. The impeller 20 is arranged on the pump rotor 8. Lubricant is received from the liquid lubricant line 17. Arrows indicate the flow direction from an end cover 28 into the impeller 20. From the impeller, lubricant flows in several conduits, lubricating bearings, more specifically thrust bearings 18*t* and radial bearing 18*r*, as well as seals s. In the illustrated embodiment, a suction cover 29, at the main inlet to pump impellers, are also illustrated. The lubricant delivered from the liquid lubricant line 17 is preferably directed into an inflow lubricant channel coaxial to the rotational axis of the pump rotor 8, as illustrated by arrow 17. Preferably, similar arrangement is provided at both ends of the rotor. The arrow 30 radially outwards from the static end cover 28 illustrate that part of the pressurized lubricant is directed to the further bearings at or towards the opposite end of the rotor 8. In addition to bearing lubrication 18, the lubricant delivered from the liquid lubricant line preferably also lubricates, cools and provide hydrodynamic stabilization of the process compartment side of the preferable magnetic coupling 22, also illustrated by the arrow 30 radially outwards from the static end cover 28. Alternatively, the liquid lubricant line or -conduit is divided or two liquid lubricant lines/-conduits are arranged, and liquid lubricant is directed to bearings at both ends of the pump rotor. However, only details essential for the understanding of the present invention are illustrated, not to scale, and not including full details or the whole pump, for increased clarity.

Figure 3:
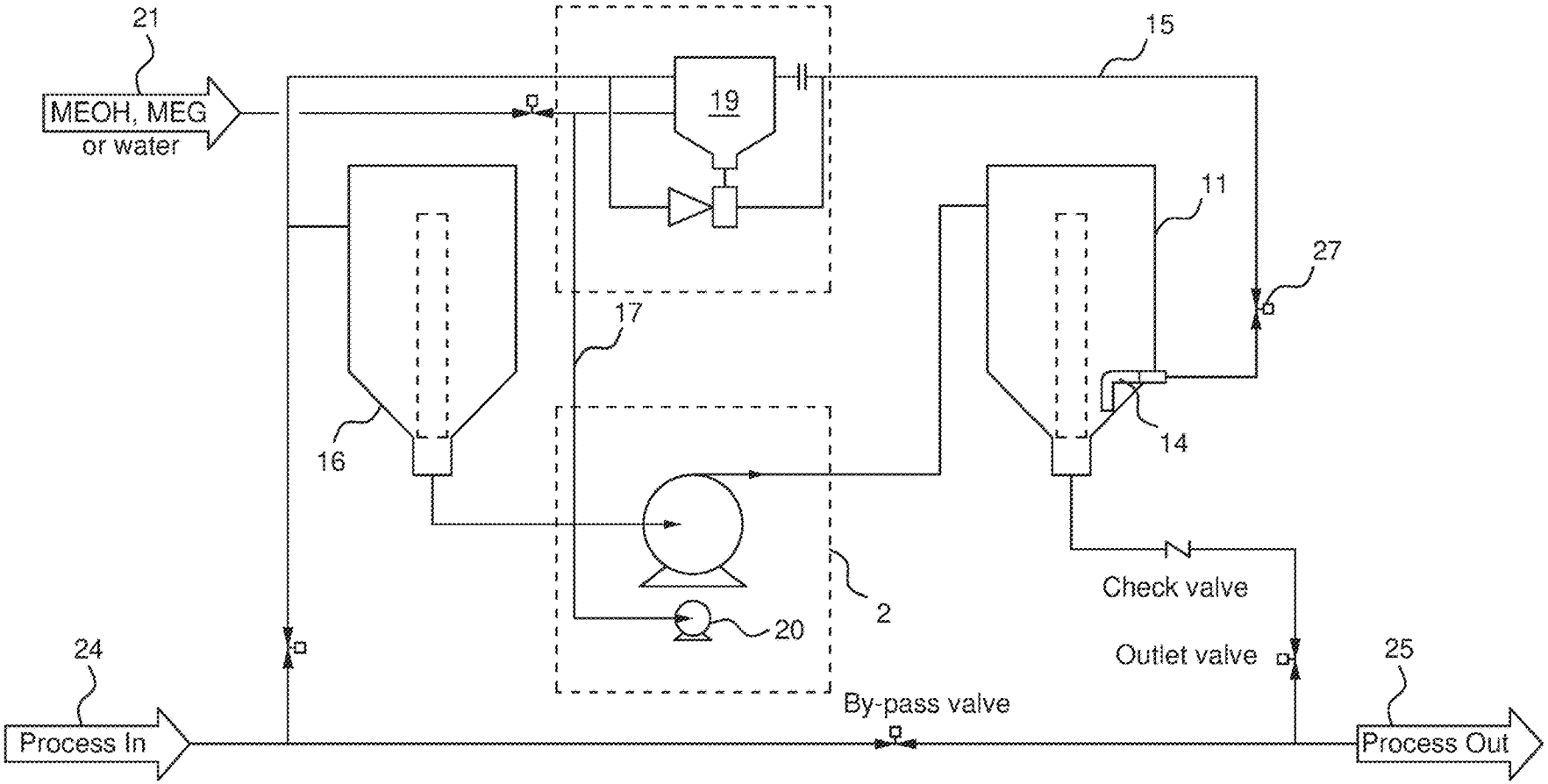
FIG. 3 illustrates an embodiment of a subsea pump system of the invention.

FIG. 3 illustrates an embodiment of a subsea pump system of the invention, illustrating in more detail. A control valve 27 in the liquid recirculation line 15 can ensure a minimum recirculation flow of liquid, for sufficient cooling and lubrication, which can be required for multiphase pumps. The liquid phase separator 11, and also the second stage liquid separator 19, are in the illustrated embodiment combined cyclonic and gravity-based separators. The outlet 14 from the liquid phase separator 11 is arranged low towards the major flow part outlet 13, but not lowermost or outermost, to avoid liquid rich in sand content.

Figure 4:
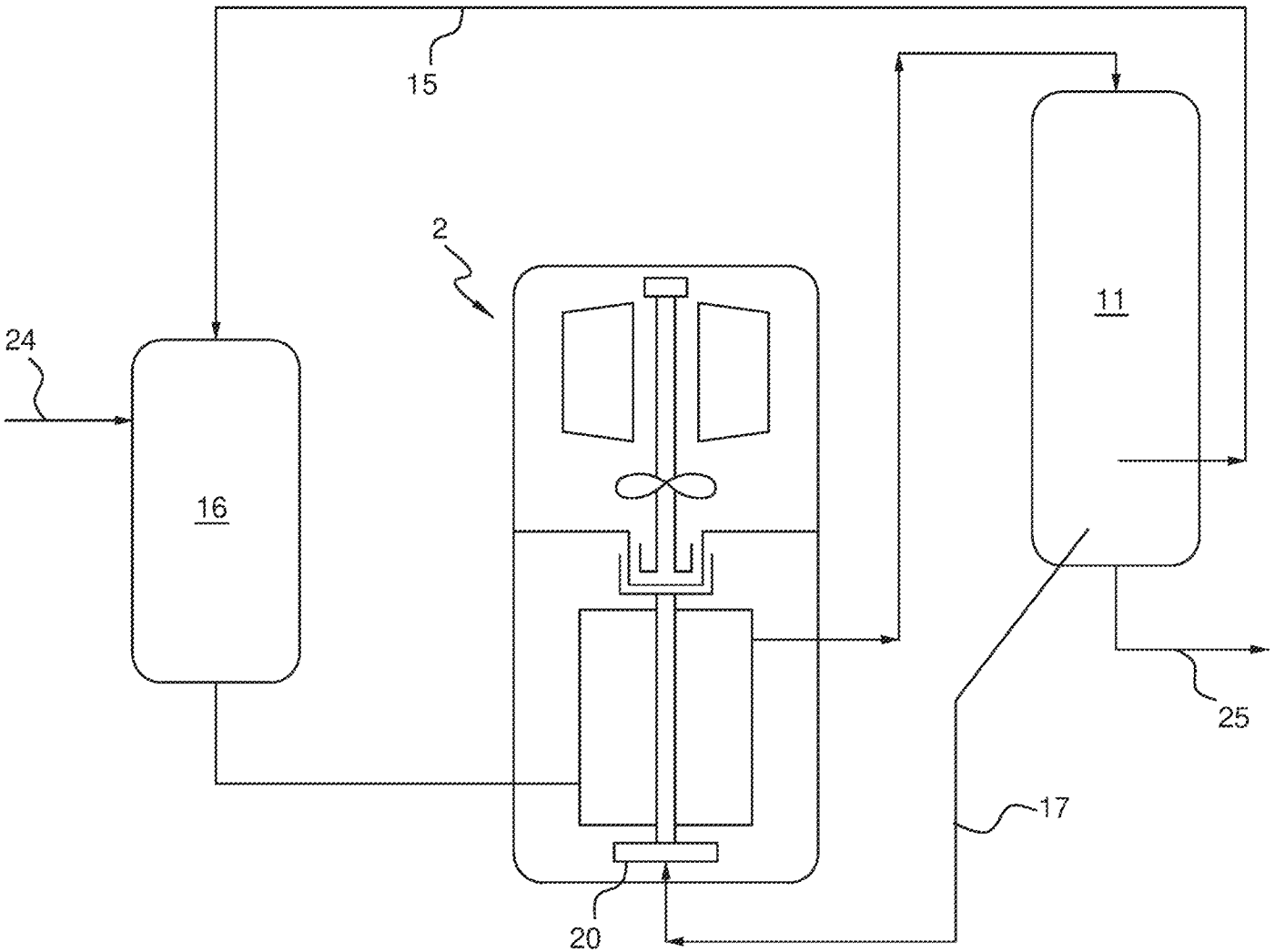
FIG. 4 illustrates a further embodiment of a subsea pump system of the invention.

Further reference is made to FIG. 4, illustrating an embodiment of the pump system of the invention for which the liquid lubricant line 17 is arranged directly from a liquid filled part of the liquid separator 11 to the pump compartment.

The subsea pump system of the invention, and the method of the invention, can include any feature or step as here described or illustrated, in any operative combination, each of which operative combinations are an embodiment of the present invention.

The invention claimed is:

1. A subsea pump system comprising:

a subsea centrifugal pump with a motor compartment and a process compartment;

wherein the motor compartment is separate from the process compartment and comprises an electric motor or stator driving a motor shaft;

wherein the process compartment comprises a pump arranged on a pump rotor, an inlet for process fluid and an outlet for pressure boosted process fluid; and wherein the motor shaft via a coupling drives the pump rotor, the subsea pump system further comprising:

a liquid phase separator arranged downstream to and outside of the pump, wherein the liquid phase separator separates the pressure boosted process fluid into two flows, namely one liquid phase flow containing some of the liquid of the pressure boosted process fluid and one flow containing a majority of the pressure boosted process fluid in the form of remaining liquid, any gas, and any solids, wherein the liquid phase separator comprises a housing with exterior fluid connections that consist of:

an inlet receiving the pressure boosted process fluid from the outlet for pressure boosted process fluid of the process compartment;

an outlet delivering the majority of the pressure boosted process fluid; and a liquid phase outlet;

the subsea pump system further comprising:

a process fluid flow mixer arranged in or upstream to the process fluid inlet of the process compartment of the pump;

a liquid recirculation line arranged from the liquid phase outlet of the liquid phase separator positioned downstream to the process compartment of the pump, to the process fluid flow mixer; and a liquid lubricant line arranged from the liquid recirculation line or the liquid phase separator, to the process compartment for lubricating one or more process compartment bearings.

2. The subsea pump system according to claim 1, comprising a liquid lubricant impeller arranged on the pump rotor.

3. The subsea pump system according to claim 1, comprising a second stage liquid separator, arranged in the liquid recirculation line, for conditioning the recirculated liquid further for service as liquid lubricant, wherein the liquid lubricant line is arranged from the second stage separator to the one or more process compartment bearings, directly or via other equipment.

4. The subsea pump system according to claim 1, further comprising an inlet for methanol, glycol or other liquid feasible for bearing lubrication, coupled to the liquid lubricant line or directly to the process compartment, for delivering the methanol, glycol or other liquid for at least one of bearing lubrication and maintaining a motor compartment overpressure.

5. The subsea pump system according to claim 1, wherein the subsea pump system comprises a magnetic coupling and a separation wall arranged between magnetic coupling parts, the separation wall separating the motor compartment hermetically from the process compartment while the motor shaft is magnetically coupled to drive the pump rotor through the separation wall.

6. The subsea pump system according to claim 1, wherein:

the pump is a subsea centrifugal multiphase pump;

liquid for process compartment bearing lubrication is separated out from the pressure boosted multiphase fluid in two stages, the liquid phase separator and a second stage liquid separator, respectively; and the liquid is supplied via a liquid lubricant line from the second stage liquid separator.

7. The subsea pump system according to claim 1, wherein the liquid for lubricating the one or more process compartment bearings is directed from the liquid lubricant line or a liquid lubricant impeller, to bearings in the process compartment.

8. A method for lubricating at least one bearing in a process compartment of a subsea pump system comprising a subsea centrifugal pump with a motor compartment and the process compartment, the method comprising:

pressure boosting a process fluid by the subsea centrifugal pump or at least one impeller thereof;

separating out two flows from the pressure boosted process fluid, namely one liquid flow with some of the pressure boosted liquid phase from the pressure boosted process fluid and one majority flow containing a majority of the pressure boosted fluid in the form of liquid, any gas and any solids, in a liquid phase separator arranged downstream to and outside of the subsea centrifugal pump, wherein the liquid phase separator comprises a housing with exterior fluid connections consisting of an inlet, an outlet and a liquid phase outlet;

discharging the separated-out liquid flow into a liquid recirculation line arranged from the liquid phase outlet of the liquid phase separator to a flow mixer arranged on an inlet side of the subsea centrifugal pump; and directing a flow of liquid fluid as lubricant to the at least one process compartment bearing, via a liquid lubricant line arranged from the liquid recirculation line.

9. The method of claim 8, wherein the directing is via a second stage liquid separator upstream to the liquid lubricant line.

10. The method of claim 9, wherein the directing is via a liquid lubricant impeller on the downstream side of the liquid lubricant line.

11. A subsea pump system comprising:

a subsea centrifugal pump with a motor compartment and a process compartment;

wherein the motor compartment is separate from the process compartment and comprises an electric motor or stator driving a motor shaft via a coupling;

wherein the process compartment comprises a pump arranged on a pump rotor, an inlet for process fluid and an outlet for pressure boosted fluid; and a liquid phase separator arranged downstream to and outside of the pump, the liquid phase separator comprises a housing with exterior fluid connections consisting of: an inlet receiving pressure boosted process fluid from at least one impeller;

an outlet delivering a majority of the pressure boosted process fluid, said majority of the pressure boosted process fluid comprising liquid, any gas and any solids; and a liquid phase outlet, delivering some of the pressure boosted liquid of the pressure boosted process fluid, separated out from the pressure boosted process fluid;

the subsea pump system further comprising:

a liquid recirculation line;

a process fluid flow mixer arranged on the inlet side of a process compartment of the pump, wherein the liquid recirculation line is arranged from the liquid phase outlet to the process fluid flow mixer; and a liquid lubricant line arranged from the liquid phase outlet, the liquid recirculation line or other location containing some of said pressure boosted liquid to one or more process compartment bearings, directly or via other equipment, for lubricating the one or more process compartment bearings.

12. The subsea pump system according to claim 11, comprising a second stage liquid separator, arranged in the liquid recirculation line, for conditioning the recirculated liquid further for service as liquid lubricant, wherein the liquid lubricant line is arranged from the second stage separator to the one or more process compartment bearings, directly or via other equipment.

13. The subsea pump system according to claim 11, further comprising an inlet for methanol, glycol or other liquid feasible for bearing lubrication, coupled to the liquid lubricant line or directly to the process compartment, for delivering the methanol, glycol or other liquid for bearing lubrication, and/or for maintaining a motor compartment overpressure.

* * * * *